US006305559B1

(12) United States Patent
Hardy

(10) Patent No.: US 6,305,559 B1
(45) Date of Patent: Oct. 23, 2001

(54) PRODUCT ORGANIZER

(75) Inventor: Stephen N. Hardy, Wadsworth, OH (US)

(73) Assignee: RTC Industries, INC, Rolling Meadows, IL (US)

( * ) Notice: Subject to any disclaimer, the term of this patent is extended or adjusted under 35 U.S.C. 154(b) by 0 days.

(21) Appl. No.: 09/597,006

(22) Filed: Jun. 20, 2000

Related U.S. Application Data

(63) Continuation-in-part of application No. 09/153,190, filed on Sep. 15, 1998, now abandoned.

(51) Int. Cl.[7] ..... A47F 5/00
(52) U.S. Cl. ..... 211/184; 211/43
(58) Field of Search ..... 211/59.2, 184, 211/43, 94.01; 108/60, 61; 312/140.3, 140.4; 248/223.41, 298.1, 224.61

(56) References Cited

U.S. PATENT DOCUMENTS

| | | | | |
|---|---|---|---|---|
| 2,728,957 | * | 1/1956 | Keller . | |
| 2,730,825 | * | 1/1956 | Wilds . | |
| 3,339,746 | * | 9/1967 | McCabe . | |
| 3,579,710 | * | 5/1971 | Gartzke . | |
| 3,868,021 | * | 2/1975 | Heinrich | 211/184 |
| 3,872,976 | * | 3/1975 | Moore et al. | 211/184 |
| 4,022,363 | * | 5/1977 | Eliassen | 211/74 |
| 4,592,530 | * | 6/1986 | Seely et al. | 248/475.1 |
| 4,615,276 | * | 10/1986 | Garabedian | 108/61 |
| 4,712,694 | * | 12/1987 | Breslow | 211/184 |
| 4,735,324 | * | 4/1988 | Wilcek | 211/184 |
| 4,779,830 | * | 10/1988 | Phelps | 248/250 |
| 4,843,977 | * | 7/1989 | Bridges | 108/152 |
| 4,869,378 | * | 9/1989 | Miller | 211/94.01 |
| 5,105,952 | * | 4/1992 | Krattiger | 211/94.01 |
| 5,341,945 | * | 8/1994 | Gibson | 211/184 |
| 5,553,412 | * | 9/1996 | Briechle et al. . | |
| 5,582,305 | * | 12/1996 | Howell, Sr. et al. | 211/184 |
| 5,682,824 | * | 11/1997 | Visk | 108/61 |
| 5,971,173 | * | 10/1999 | Valiulis et al. | 211/184 |
| 6,006,678 | * | 12/1999 | Merit et al. | 108/60 |
| 6,142,322 | * | 11/2000 | Smith et al. | 211/183 |

* cited by examiner

*Primary Examiner*—Daniel P. Stodola
*Assistant Examiner*—Jennifer E. Novosad

(57) ABSTRACT

A shelf organizer including an elongated rail member defining a channel section. The rail member includes inwardly extending legs to which are attached longitudinally extending rubber beads. A connector forming part of a shelf divider is disposed in the channel section and when the divider is located in a vertical position it will be retained in position by the beads. The divider can be readily twisted out of engagement with the beads and quickly moved to a different location with minimal effort to vary the widths of the bind whenever desired. A single bead secured to the upper or lower legs may be used in place of two beads. Also the mounting flange may include an integral portion forming a ledge that engages the bead to help retain the divider in a vertical position.

9 Claims, 2 Drawing Sheets

PRODUCT ORGANIZER

This application is a continuation-in-part of Ser. No. 09/153,190 filed Sep. 15, 1998, now abandoned, and entitled Product Organizer.

FIELD OF THE INVENTION

This invention relates to merchandise display shelves and particularly to an improved design for facilitating, organizing and dividing display shelves to accommodate products varying in widths at different points of time.

BACKGROUND OF THE INVENTION

In recent years there has been a growing trend toward self service merchandise and this requires a quick and easy way of making an orderly display of consumer products on the display shelves. It is desirable to provide an improved appearance for consumer friendly shopping and if the shelves can be made easily adjustable and readily mountable to virtually all standard shelving this would greatly facilitate the orderly display of products.

Previous designs took up a substantial portion of the depth at the front of the shelving to allow for the engagement of the product divider and its connection to the front retainer. It would be desirable to provide a new shelving system that permits quick and easy adjustment when reorganizing shelves for changes in product size and yet utilize a minimal amount of shelf depth for the management of the product divider and product identification or pricing.

Typically, an elongated shelf having a standard length will be subdivided by a series of vertical walls or dividers to provide separate bins of suitable widths to accommodate the various products being displayed therein. Each bin should be readily able to carry easily visible information relating to pricing, advertising or consumer information for the particular product contained therein. Product shapes and sizes vary greatly and since inventory, promotions and sales are consistently changing there is need for virtually an infinite number of adjustable positions for the shelf dividers.

Conventional shelving is made of sheet metal or in some instances wood and therefor is designed for relatively long term use and requires substantial financial investment. Obviously, it is not feasible to replace such shelving whenever changes in organization of the product being displayed are required. There thus exists a need for an improved and relatively inexpensive organizer system that can be readily used with existing support structure.

SUMMARY OF THE INVENTION

The present invention provides a shelf organizer structure that may be readily attached to existing conventional shelving yet, include a shelf divider construction that is capable of virtually infinite adjustablity.

Briefly, the shelf organizer comprises a two element assembly, namely a front stop rail and a vertical divider. A plurality of such dividers is adapted to be slidably and releasably retained relative to the stop rail. The stop rail includes a horizontal leg attachable to an existing shelf and a vertical front face. The front face is located in the upper portion of the stop rail and includes curved opposing sections that define with the front face a longitudinal channel adapted to receive product indicia and the front portion of vertical dividers that divide the shelf into separate bins.

The divider assembly includes a front plate portion that is disposed normal to the divider section of the assembly and is receivable in the longitudinal channel. The curved opposing section of the channel includes inwardly extending legs that define the entry into the channel section. In the primary embodiment one of the legs has secured thereto a longitudinally extending bead portion that is flexible to receive and retain the divider in its vertical position when so disposed. In the preferred embodiment the bead is made of a flexible polyvinyl chloride. Thus, the vertical height of the divider is designed so that when it is disposed in the vertical position relative to the channel section a portion of it fits within the rubber bead and thus is retained in position relative to the stop rail. It can be appreciated that with this construction a mere twisting of the shelf divider would free it from the rubber bead and it can be slid along the channel section and reinserted to provide what ever spacing desired relative to an adjacent divider to form a bin with minimum effort to accommodate a particular package width. Both elements of the organizer are preferably made of extruded or molded available clear plastic. As a result the stop rail channel serves the dual function of supporting the vertical divider and retention of product information cards, which are readily legible to the customer and yet protected from intentional or inadvertent abuse or damage.

In a second embodiment each of the legs have secured thereto longitudinally extending rubber bead portions. Numerous other advantages and features of the present invention will become readily apparent from the following detailed description of the invention, from the claims, and the accompanying drawings.

In both of the embodiments there may be provided a transversely extending ledge portion that presents a larger contact surface with the inwardly extending flanges to assist in maintaining the dividers in the vertical position.

BRIEF DESCRIPTION OF THE DRAWINGS

In the accompanying drawings forming a part of the specification and in which like numerals are employed to designate like parts throughout.

DETAILED DESCRIPTION OF THE INVENTION

Figure 1:
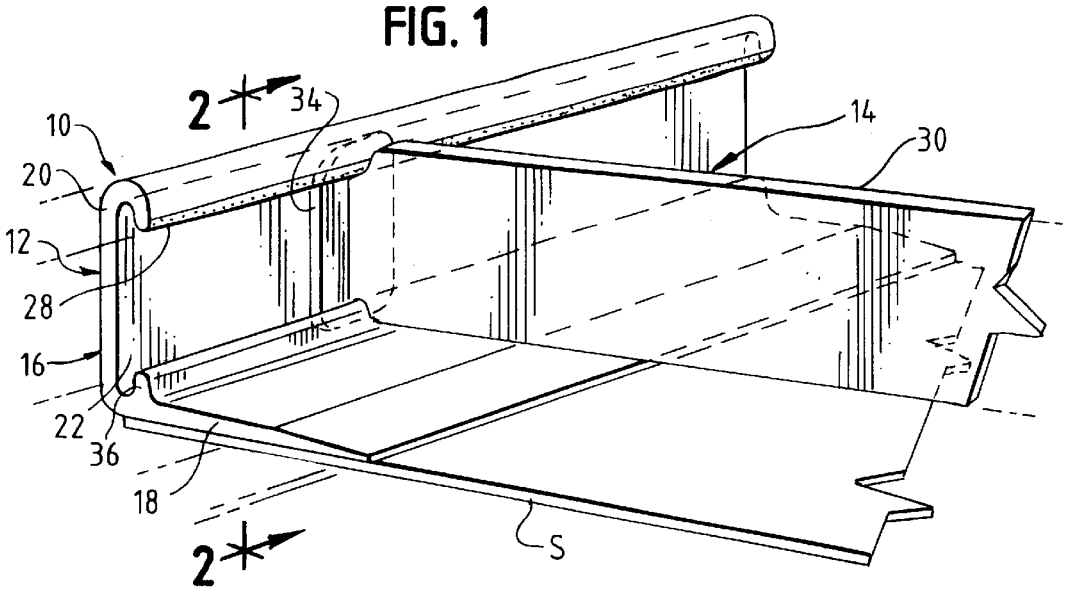
FIG. 1 is a fragmentary perspective view showing a divider mounted in place relative to the front channel section in which the upper leg of the channel section includes a longitudinally extending rubber bead secured thereto.

Referring with greater particularity to the Figures of the drawings there is seen that the reference numeral 10 indicates generally a shelf organizer embodying the principles of the invention. The shelf organizer 10 is comprised of two parts, a front stop rail assembly 12 and a vertical divider member 14. A plurality of divider members are connectable to the rail assembly 12 to provide an operational shelving arrangement consisting of separate bins to accommodate products of different widths.

Stop rail assembly 12 comprises an elongated L shaped member 16 having a horizontal mounting foot 18 and a vertical leg 20. Rail leg 20 forms part of an integral channel 22, that is further defined by a curved downwardly extending top leg 24 and an upwardly extending bottom leg 26 projecting upwardly from the horizontal mounting foot 18. In FIG. 1 there is shown connected to the end of the downwardly extending top leg a longitudinally extending rubber or flexible PVC bead 28 that defines with the bottom leg 26 the channel opening. The rail assembly 12 is preferably in standardized lengths, such as 3 feet or 4 feet and the leg 18 is suitably connected by rivets or screws (not shown) to the shelves. The mounting foot 18 preferably tapers rearwardly to a relatively thin edge and thereby provides minimal resistance to products on shelf S being slid thereover onto the foot.

In the embodiment of FIGS. 1–4, which is not intended to be limiting the divider member 14 includes an elongated panel 30 having a vertical height substantially equal to the height of the rail leg 20. At its front edge the panel 30 includes a mounting flange 34 that is disposed normal to the panel 30 and is positioned to fit into the channel 22. As seen in FIG. 3A it is generally rectangular in shape and is curved in its opposite corners to facilitate rotation and the bead 28 engages the upper and lower grooves of the divider to hold the divider assembly 14 in the position as shown in FIG. 3B.

Figure 2:
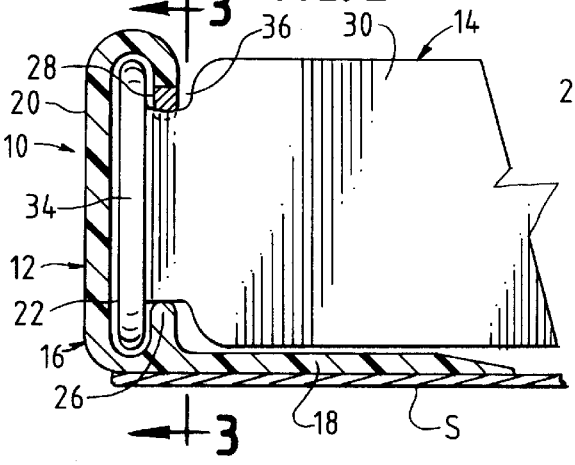
FIG. 2 is a side view showing the divider in position relative to the front channel section.
Figure 3A:
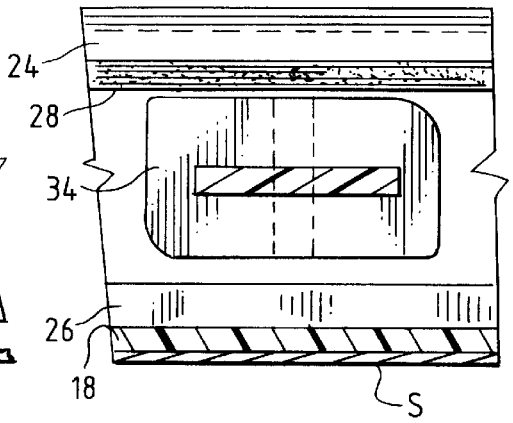
FIG. 3A is a view generally taken along line 3—3 of FIG. 2 showing the position of the divider prior to being twisted into the position shown in FIG. 3B.
Figure 3B:
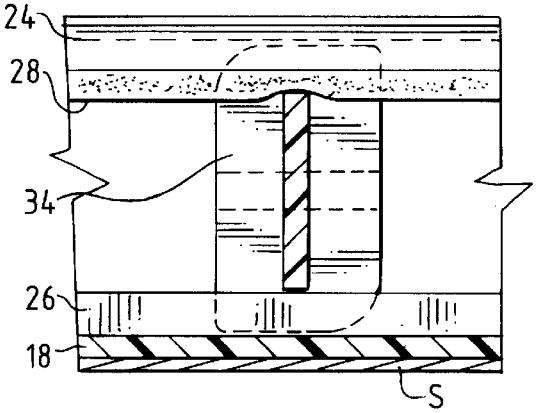
FIG. 3B shows the divider locked in position relative to the channel by indentation into the longitudinally extending upper bead.

In the illustrated embodiment the divider is formed with grooves 36 and the distance between the grooves is slightly greater then the distance between the bead 28 and leg 26 (the opening into the channel) whereby when the divider is twisted into the position as shown in FIGS. 2 and 3B the divider indents the resilient bead and is thus resiliently held in the position shown.

Figure 4:
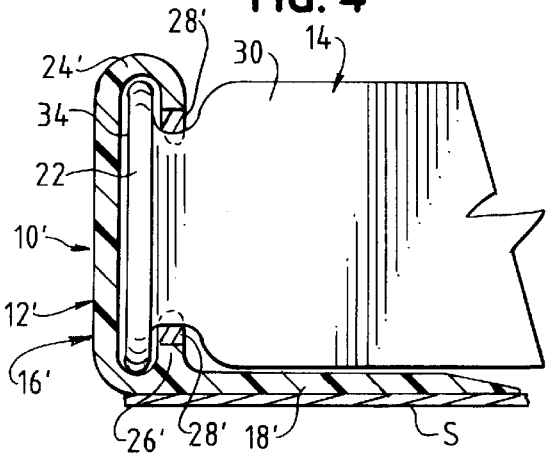
FIG. 4 illustrates a second embodiment in which both legs of the channel section have a longitudinally extending rubber bead secured thereto.

In a second embodiment as shown in FIG. 4 there are included longitudinally extending beads 28 secured to each of the legs 24 and 26.

Figure 5:
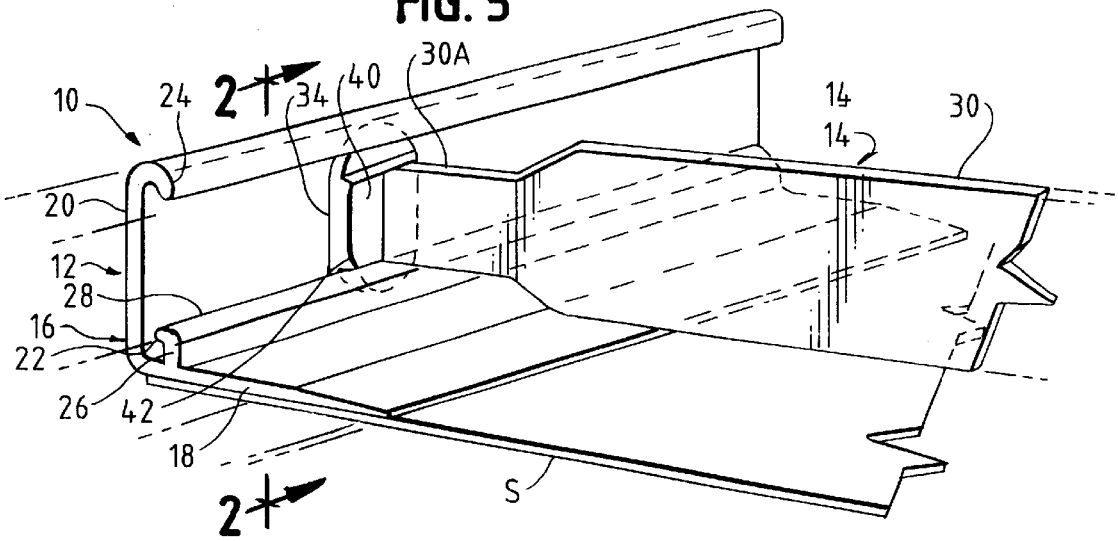
FIG. 5 is a view similar to FIG. 1 including a single lower bead and a mounting flange with a ledge that engages the lower leg to assist in maintaining the divider in the vertical position.
Figure 6:
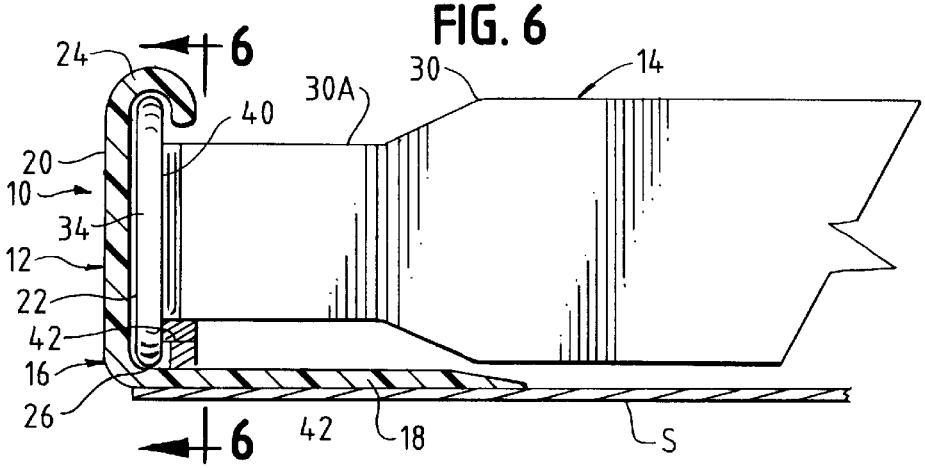
FIG. 6 is a side view showing the binder in position relative to the front channel.
Figure 6A:
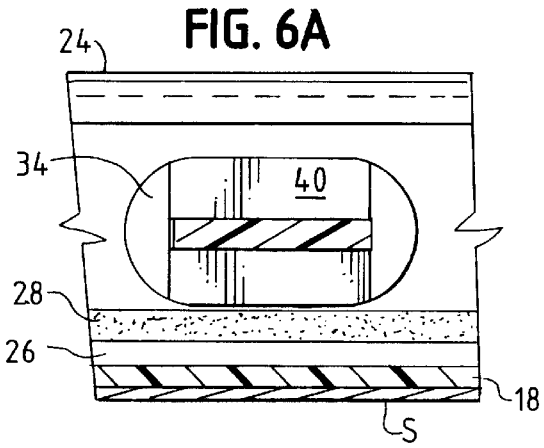
FIG. 6A is a view taken generally along line 6—6 of FIG. 6 showing the position of the divider prior to being twisted into the position shown in 6B.
Figure 6B:
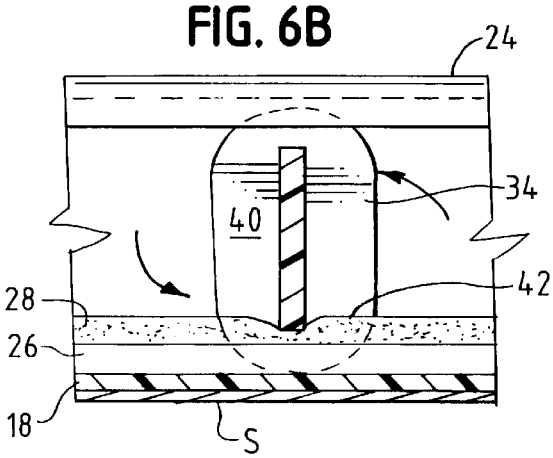
FIG. 6B shows the divider locked in position relative to the channel by indention into the longitudinally extending lower bead.

Referring now to FIGS. 5–6B there is provided a transversely extending member 40 that is formed integral with the mounting flange 34. This member 40 includes a ledge 42 that engages the resilient bead 28 (see FIG. 6B) to maintain the divider substantially vertical. In this embodiment the front portion 30 of the divider is reduced in size and has the vertical height of the transversely extending member 40.

As indicated, each of the members are integrally molded from suitable molded transparent plastics. As a result the rail member serves the dual function of retaining flexible information cards (not shown) that may be inserted into the channel where upon they are legible to the consumer while being protected from external mutilation. It is appreciated that the plurality of divider members typically will be operationally assembled relative to the rail member to provide the number and width of product bins desired.

It should, of course, be appreciated from the forgoing detailed description of the invention and the illustrative embodiment thereof that numerous variations and modifications may be effected without departing from the true sprit and scope and novel concept of the principles of the invention.

What is claimed:

1. A shelf organizer comprising an elongated rail member having a bottom mounting portion and an upwardly shaped channel including a front wall and inwardly directed leg portions defining a space therebetween with at least one leg portion including a flexible bead secured thereto, said mounting portion being attachable to a shelf, an elongated divider member having a front edge and connecting means integral with the front edge thereof and extending normal thereto and being fittable in said channel, said divider member having a width wider than the space between said leg portions, whereby when the divider member is operationally mounted in substantially vertical orientation perpendicular to said front wall and the connecting means is disposed in said channel, the divider member will be retained in position by said bead.

2. A shelf organizer set forth in claim 1 in which both of said leg portions have a flexible bead secured thereto.

3. A shelf organizer as set forth in claim 2 in which the divider member defines grooves adjacent said connecting means into which the beads fit when the divider member is moved into position to serve as a divider.

4. A shelf organizer set forth in claim 1 in which the bead is made of rubber.

5. A shelf organizer set forth in claim 4 in which the connecting means has a height generally equal to that of the channel and a width less than the space between the leg portions so that the connecting means can readily enter said channel and the divider member can be twisted into position to engage the bead to be retained in place but can be readily released therefrom and moved to a different position to readily accommodate products of a different width.

6. A shelf organizer according to claim 1 in which the rail member is made of a transparent plastic whereby a card retained in said rail member is legible therethrough.

7. A shelf organizer comprising an elongated rail member having a bottom mounting portion and an upwardly shaped channel including a front wall and inwardly directed leg portions defining a space therebetween with at least one leg portion including a flexible bead secured thereto, said mounting portion being attachable to a shelf, an elongated divider member having a front edge and connecting means integral with the front edge thereof and extending normal thereto and being fittable in said channel, said connecting means including a transversely extending section located between said inwardly directed leg portions, whereby said section is positioned to engage said bead to help maintain the rail member in a vertical position.

8. A shelf organizer as set forth in claim 7 in which the inwardly directed leg portions consist of upper and lower leg portions and the flexible bead is part of the lower leg portion.

9. A shelf organizer as set forth in claim 8 in which the bead is made of polyvinyl chloride and is formed integral with the lower leg portion.

* * * * *